US006531219B1

(12) United States Patent
Fare'

(10) Patent No.: US 6,531,219 B1
(45) Date of Patent: Mar. 11, 2003

(54) CONTINUOUS AND/OR DISCONTINUOUS THREE-COMPONENT POLYMER FIBERS FOR MAKING NON-WOVEN FABRIC, AND PROCESS FOR THE REALIZATION THEREOF

(76) Inventor: Rosaldo Fare' , Via Papa Giovanni XXIII, 20, Fagnano Olona Va (IT), 21054

( * ) Notice: Subject to any disclaimer, the term of this patent is extended or adjusted under 35 U.S.C. 154(b) by 223 days.

(21) Appl. No.: 09/660,514

(22) Filed: Sep. 12, 2000

(30) Foreign Application Priority Data

Feb. 15, 2000 (IT) ..... M120A0245

(51) Int. Cl.[7] ..... D01F 8/00

(52) U.S. Cl. ..... 428/373; 428/374; 428/370

(58) Field of Search ..... 428/370, 373, 428/374; 325/166, 177

(56) References Cited

U.S. PATENT DOCUMENTS 4,424,258 A * 1/1984 Bach ..... 428/370
5,364,694 A * 11/1994 Okada et al. ..... 428/373
5,948,529 A * 9/1999 Hasties ..... 428/373

* cited by examiner

*Primary Examiner*—N Edwards
(74) *Attorney, Agent, or Firm*—Nixon & Vanderhye P.C.

(57) ABSTRACT

Continuous and/or discontinuous three-component fibers of the "sheath-core" type, provided with an external structure of the annular sheath type, made from polyolefin or co-polyester polymer material and an inner core or nucleus constituted of two different polymer materials such as, for instance, polyolefin resins and polyester resins, in suitable amounts. Process for the preparation of said three-component fibers and utilization thereof in the sector of civil and industrial engineering for making also short-cut multi-use fibers or "fiber-fill" for cotton-wool, and for use in paper-making or for realization of non-woven fabric to be used, for instance, in the health sector.

18 Claims, No Drawings

CONTINUOUS AND/OR DISCONTINUOUS THREE-COMPONENT POLYMER FIBERS FOR MAKING NON-WOVEN FABRIC, AND PROCESS FOR THE REALIZATION THEREOF

OBJECT OF THE INVENTION

The present invention relates to continuous and/or discontinuous three-component polymer fibers of the "sheath-core" type, a process for the preparation thereof, and their use in the health, civil engineering sectors, and the like.

PRIOR ART

As is known, in the last years, the sector of synthetic fibers utilizable to make non-woven fabric has undergone a remarkable development. In particular, there have been recently developed the so-called "two-component" fibers, which have the characteristic of being formed by the combination of two different polymers. These "two-component" synthetic fibers are generally of the "sheath-core" type, wherein a component represents the central nucleus or core, while the other one represents the external sheath, or of the "side-by-side" type, wherein the two different components flank each other in the realization of the fibers.

The "two-component" fibers of the above described type according to the prior art are utilized, for instance, for the production of non-woven fabric, which is employed, in its turn, in various fields, such as clothing, building, home furniture, and health. In particular, a field wherein non-woven fabric realized with synthetic "two-component" fibers has a remarkable use is the health sector, for the production of napkins and products for incontinence. As is obvious, these products must satisfy some characteristics, such as the softness of the external layer in touch with the skin, the permeability of the external layer, the absorption capacity, the thickness of the external/internal layers and many other characteristics. Therefore, the fibers they are made from shall have specific characteristics of elasticity, softness, resistance, permeability, and be suitable for being worked with conventional machines.

OBJECT OF THE INVENTION

Therefore, object of the present invention is to provide a synthetic fiber having chemical-physical characteristic that may be modulated according to the use which said fiber is intended for.

Another object of the present invention is to provide a synthetic fiber suitable for making a non-woven fabric having high characteristics of elasticity, fluid-permeability and softness.

Another object of the present invention is to provide a synthetic fiber having a specific weight that can be modulated according to the use which said fiber is intended for.

Still another object of the present invention is to provide a synthetic fiber having variable and pre-determinable physical-mechanical characteristics.

A further object of the present invention is to provide a synthetic fiber that may be used either directly or through further processes for instance in the sectors of health, paper making, home furniture and civil and industrial engineering.

Still another object of the present invention is to provide a synthetic fiber having high technical characteristics and that is advantageous from the economic point of view.

Another object of the present invention is to provide a process for making a synthetic fiber provided with the above characteristics.

DESCRIPTION OF THE INVENTION

These and still other objects and associated advantages that will be better clarified by the following description are achieved by a synthetic fiber of the so-called "sheath-core" type, characterized in that the inner nucleus or core is manly constituted of at least two polymer materials different form each other and mixed in suitable amounts, while the external sheath is mainly constituted of one-only polymer material.

In particular, said inner nucleus or core is preferably composed of a polyolefin resin and a polyester resin mixed to each other such as are in suitable amounts, while said external sheath is preferably composed of 100% polyolefin resin or co-polyester resin.

The synthetic fiber according to the present invention is therefore a "three component" fiber of the "sheath-core" type, wherein the inner core is composed of a mixture of polyolefins and polyesters, wherein the polyester component does not exceed 50% with respect to the total mixture, while the external sheath is 100% low-melting polyolefin or co-polyester polymer material. Said three-component fibers are of the round-section continuous (threads) or discontinuous (staple) types, wherein the external sheath is of the annular type, while the inner core has prevailingly a round section.

The three-component fiber according to the present invention is obtained by preliminary mixing the two components of the central core during the pre-extrusion step, so that said components may afterwards be jointly extruded to form the core or nucleus of said fiber, while the external sheath is co-extruded on the central nucleus.

An apparatus suitable for making the three-component fiber according to the present invention is, for instance, that described in U.S. Pat. No. 5,869,106 "APPARATUS FOR MAKING TWO-COMPONENT FIBERS" according to which the different polymer fiber components are fed already during the pre-extrusion step and afterwards jointly extruded in such a manner as to allow a convenient control of the distribution of the polymer materials that will form the fiber and therefore the exact characteristics of said fiber. U.S. Pat. No. 5,869,106 discloses the utilization of the aforesaid apparatus for making "two-component" fibers of either the "sheath-core" or the "side-by-side" type according to the prior art, but that can be suitably adapted for the realization of "three-components" fibers according to the present invention.

Said two polymer materials that constitute the base of the inner core of the three-component fiber subject matter of the present invention have, thanks to the chemical-physical characteristics, the particularity of maintaining their original properties unaltered, even though they are intimately mixed and jointly extruded at high temperature. Besides, as the polymer materials that constitute the inner nucleus or core are different from each other, they have different specific weights, and polyolefins in particular have specific weights ranging from 0,92 to 0,95 g/cm$^3$, while polyesters have specific weights of about 1,38 g/cm$^3$.

As a consequence, the specific weight of the three-component fibers according to the present invention will be an intermediate weight with respect to the specific weights of the polymer materials employed for the realization of the inner core and the sheath, and will depend on the relative amounts of said components. This fact allows therefore to modulate within a very wide range the technical characteristics of the three-component fiber obtained, based on the use for which it is intended, and represents a remarkable advance compared to the prior art, wherein, instead, the fiber, being constituted by a one-component central core (in the case of "sheath-core" fibers), has always the same characteristics that cannot be varied in any way according to the characteristics of the central core. Besides, the physical-mechanical characteristics of the three-component fibers according to the invention result from a combination of those that are typical of polyolefin or polyester one-component fibers, or those of two-component fibers, wherein however the central core is constituted of one only polymer material. The external sheath, having a prevailingly annular structure, of the three-component fibers according to the invention, imparts said fibers the specific technical properties and the properties of resistance against chemical agents as the polymer material employed for making the sheath.

Said sheath may be advantageously made from polyolefin resin such as a homo- or co-polymer, or from co-polyester resin, which has a melting point lower than that of the polyolefin resin and also than the polyester resin. In this case, the melting point of the external sheath is markedly lower than that of the material that constitutes the fiber nucleus or core, so that an effective adhesion is obtained between the fiber sheath and the core.

The three-component fibers subject matter of the present invention may be conveniently obtained according to the traditional technological processes, for instance, for the discontinuous fiber, compact spinning (short spinning) or, for the continuous fiber, two-step spinning (long spinning), for instance continuous threads of POY, FOY type and the like, in the most commonly used counts of textile industry. In any case, they are fibers having a high mutual weldability.

In particular, said continuous fiber or thread according to the invention is advantageously made with a count ranging from 0.75 dtx and 3000 dtx.

The three-component fibers according to the invention are advantageously employed for making no-woven fabric, obtained, for instance, from card webs or from laps of continuous threads obtained by extrusion and stretching (spun-laid process), and consolidated afterwards by means of different thermal treatments, for instance in a calender, hot air circulation ovens, and the like, and also of lapped fibrils with the so-called "melt-blown" process or also with water jet treatments or a mechanical treatment on needling machines, followed by thermal treatment.

The three-component fibers according to the present invention are therefore advantageously used in sectors such as health, non-woven fabrics for "cover-stock", "back-sheet", "A.D.L.", "high-loft", "spun-lace", civil engineering, such as for instance non-woven fabrics for geotextiles and roofing, short-cut multi-use fibers, for instance "air laid" and concrete reinforcement fibers, as well as "fiber-fill" for cotton-wool. In the latter case, it is possible to obtain a cotton-wool having particular characteristics, as the three-component fiber according to the invention is characterized by a specific weight lower than that of COPET-PET "fiber-fill" fibers (sheath from co-polyester—core from polyester) according to the prior art. In fact, as the three-component fiber according to the present invention has a specific weight lower than COPET-PET fiber according to the known art, thanks to the presence of the polyolefin component (with a low specific weight), the cotton-wool obtained with said three-component fiber is characterized by a greater bulkiness, even though it is extremely resistant to dry-wash operations thanks to the external sheath which, being 100% constituted of co-polyester polymer, is solvent-resistant.

Again, the fibers according to the present invention are advantageously used, also as a continuous thread, for making technical fabrics, utilized, for instance, for the filtration of air, waters/liquids and/or grounds, or for other types of filtration, for instance in the health field.

By way of non limiting example of the present invention, there is reported below an example of realization of a three-component fiber according to the present invention and of use of the same for the preparation of a non-woven fabric.

EXAMPLE 1

Continuous or Discontinuous Three-component Fibers (Filaments)

| | | |
|---|---|---|
| COUNT | 2.2 dtx | 6.7 dtx |
| SECTION | ROUND | ROUND |

CORE (in Convenient Ratios of ) PES and PP PES and PP

| | | |
|---|---|---|
| SHEATH | 100% FE | 100% PE |
| STRENGTH | 1.5 cN/dtx | 2 cN/dtx |
| ELONGATION | 70–100% | 70–100% |

The technical characteristics of melting and softening temperatures are those specific for PES (polyester), PP (polypropylene) and PE (polyethylene).

EXAMPLE 2

Weight of non-woven fabric from card web 25 g/m$^2$

Percentage of three-component fiber used 100%

Count of "sheath-core" three-component fiber used 2,5 dtex

| | |
|---|---|
| Fiber length | 40 mm |
| Average strength | 1,8 cn/dtex |
| Ultimate elongation of the fiber | 100% |
| Oiling used and applied to the fiber hydrophile | permanent |

hydrophile or hydrophobic

POLYMERS employed for the production of the fiber

INNER NUCLEUS OR CORE: 44%

80% MFI/12 polypropylene. Extrusion spinning temperature: 280° C.

20% polyester. Intrinsic viscosity (I.V.): 0,65.

Water parts: <50 ppm

Extrusion spinning temperature: 280° C.

EXTERNAL SHEATH: 56%

100% MFI/18 low-melting polyethylene

SPINNING TREATMENT

Extrusion spinning temperature: 280° C.

Temperature of fiber air cooling during extrusion: 28° C. R.U. 60%

Stretching temperature: 110° C.

Thermosetting temperature: 100° C.

Stretching ratio: 2,5/1.

In order to obtain the three-component fiber according to the present invention, three types of specific extruders have been used for the polymers. Two of these polymers (polypropylene and polyester) have been mixed during melting. Afterwards, these polymers have been injected, in a suitable manner, into the feeding channels of the spinner which has then generated the three-components fibers, according to the disclosure of U.S. Pat. No. 5,869,106 and with the aforesaid process conditions.

The mechanical characteristics of the non-woven fabric obtained, M-D (machine direction) and C-D (cross direction), are due to the fusion by melting of the "sheath" polymer, i.e. the one which the external sheath is made from, in particular in the example described for polyethylene, which took place at 130–135° C. in a special air circulation oven or in a hot roller calender.

The process for making non-woven fabrics of the "AIR BONDING" type is part of the state of the art, as well as "THERMO BONDING" in a calender.

In the example reported above, the main advantage concerning the use of the three-component fiber described is represented by the resilience effect due to the presence of polyester in the fiber nucleus or core. In fact, in the fiber core, polyester is immersed in polypropylene, which is the other polymeric component of said core. The good combination of the two polymers of the core is of the essential to obtain a constant of continuity, strength and fiber orientation capacity in the mechanical step of molecular orientation.

The inner nucleus or core of the fibers according to the invention provides the characteristics of mechanical resistance or resilience, while the external sheath that wraps up the central core undergoes a subsequent fusion. During the fusion step that will bind the fibers to each other, the fiber core shall have temperature resistance characteristics and undergo as low a loss of mechanical characteristics as possible.

Once the thickness of the non-woven fabric obtained has been determined, the resilience effect (molecular memory with the capacity of returning to the original form) of polyester allows also a greater winding tension and therefore an increase in the weight of non-woven fabric rolls. At the treatment temperatures of olefin polymers (polyethylene and polypropylene), in the formation step of the non-woven fabric, polyester does not undergo any deformation, and this allows to obtain optimum resilience results.

The pressure exercised on the three-component 100% non-woven fabric of the "AIR BONDING" type being the same, the greater resilience of the three-component fibers with respect to the fibers of the known art, allows to keep the passages between the fibers well open and to help the passage of air and/or liquids.

EXAMPLE 3

Non-woven Fabric for Application in the Health Field

Non-woven fabric from discontinuous fiber card web obtained with 30% three-component fiber of the type described in Example 2, with a 2.2 dtx count and 70% PP discontinuous fiber with a 6.7 dtx count.

Weight of the non-woven fabric: 30 g/m$^2$ thermal consolidation by hot air circulation oven.

Such non-woven fabric that binds 2.2 dtx three-component discontinuous fibers with 6.7 dtx middle-high count discontinuous fibers ensures the functional realization of the product which has to be porous, elastic and resilient.

100% non-woven fabric from three-component fiber from three-component filament lap of 2.2 dtx count weighing 18 g/m$^2$, thermally consolidated in a hot roller calendar.

The above fabric has the advantage of being made from continuous filaments that are individually more strong than two-component filaments.

What is claimed is:

1. A sheath-core fiber wherein the inner nucleus or core is mainly constituted of at least two polymer materials different from each other and mixed in suitable amounts, where a polyester resin content of the core does not exceed 50% with respect to the total of the core constituting materials, while the external sheath is mainly constituted of one only polymer material.

2. The sheath-core fiber of claim 1 wherein said inner nucleus or core is made from a polyolefin resin and a polyester resin mixed with one another.

3. The sheath-core fiber according to claim 1 wherein said external sheath is made entirely from a polyolefin resin or a co-polyester resin.

4. The sheath-core fiber according to claim 1 wherein said external sheath is made from a low-melting polymer material.

5. The sheath-core fiber according to claim 1 wherein the fiber is continuous, the core is round in cross-section and the external sheath is annular.

6. The sheath-core fiber according to claim 1 wherein the fiber is discontinuous, the core is round in cross section and the sheath is annular.

7. The sheath-core fiber according to claim 1 wherein the core is a mixture of a polypropylene and a polyester.

8. The sheath-core fiber according to claim 1, wherein the core is a mixture of a polyethylene and a polyester.

9. The sheath-core fiber according to claim 1, wherein the sheath is a polyolefin resin.

10. The sheath-core fiber according to claim 1 wherein the sheath is a co-polyester resin.

11. The sheath-core fiber according to claim 1 wherein the polyolefin has a specific weight of 0.92 to 0.95 g/cm$^3$.

12. The sheath-core fiber according to claim 1, wherein the polyester has a specific weight of about 1.38 g/cm$^3$.

13. The sheath-core fiber of claim 1 , wherein the fiber has a count ranging from 0.75 to 3000 dtx.

14. Sheath-core fiber according to claim 5 or 6, wherein the fiber has a count of 2.2 to 6.7 dtx a strength of 1.5 to 2 cN/dtx and an elongation of 70 to 100%.

15. A process of making the sheath-core fiber of claim 1, wherein it comprises the steps of:

(a) mixing the polymers constituting the core, (b) jointly extruding the mixture of polymers forming a core, and (c) jointly extruding the sheath on the core while the core is being extruded.

16. The sheath-core fiber according to claim 1, wherein the fiber is obtained through a compact spinning process or a two-step spinning process.

17. A non-woven fabric for use in the health field, composed of the sheath-core fiber of claim 1.

18. Cotton-wool made with the sheath-core fiber of claim 1.

* * * * *